US005636833A

United States Patent [19]

Maier et al.

[11] Patent Number: 5,636,833

[45] Date of Patent: Jun. 10, 1997

[54] APPARATUS FOR THE UNDERLAP IMBRICATED FEEDING OF SHEET-LIKE PRINTING SUBSTATES TO A PRINTING MACHINE AND METHOD

[75] Inventors: Karl-Ludwig Maier, Rodgau; Arno Gartner, Muhlheim; Nikola Pupic, Heusenstamm; Bert Cappel, Muhlheim, all of Germany

[73] Assignee: MAN Roland Druckmaschinen AG, Germany

[21] Appl. No.: 423,529

[22] Filed: Apr. 17, 1995

[30] Foreign Application Priority Data

Apr. 15, 1994 [DE] Germany ..... 44 13 089.9

[51] Int. Cl.[6] ..... B65H 05/24; B65H 05/22; B65H 05/02

[52] U.S. Cl. ..... 291/276; 271/105; 271/151; 271/195; 271/197

[58] Field of Search ..... 271/94, 104, 105, 271/151, 195, 197, 276

[56] References Cited

U.S. PATENT DOCUMENTS

| | | | |
|---|---|---|---|
| 3,054,613 | 9/1962 | Forrester | 271/195 |
| 3,355,166 | 11/1967 | Plumb | 271/195 |
| 3,907,278 | 9/1975 | Jaton | 271/94 |
| 4,361,317 | 11/1982 | Lapp-Emden | 271/94 |
| 5,241,907 | 9/1993 | Dorsam et al. | 271/195 |
| 5,288,067 | 2/1994 | Stock | 271/197 |
| 5,478,066 | 12/1995 | Yoshida et al. | 271/94 |

FOREIGN PATENT DOCUMENTS

| | | | |
|---|---|---|---|
| 713529 | 11/1941 | Germany . | |
| 1 033 225 | 7/1958 | Germany . | |
| 1 186 473 | 9/1965 | Germany . | |
| 252343 | 12/1976 | Germany | 271/195 |
| 32 34 155 A1 | 3/1984 | Germany . | |
| 38 38 078 A1 | 6/1989 | Germany . | |
| 33 31 662 C2 | 3/1990 | Germany . | |
| 40 12 948 C2 | 3/1992 | Germany . | |
| 4231891 | 3/1994 | Germany | 271/197 |

*Primary Examiner*—William E. Terrell
*Assistant Examiner*—Richard A. Chandler
*Attorney, Agent, or Firm*—Leydig, Voit & Mayer, Ltd.

[57] ABSTRACT

An apparatus and method for feeding a stream of underlap-imbricated sheet-like printing substrates to printing machine, the apparatus comprising a conveying table for conveying the stream in a conveying direction toward the printing, a source of compressed air, and at least one blowing device coupled to the source of compressed air, the blowing device being disposed in a region of the conveying table adjacent to printing machine, and including at least one opening disposed to direct compressed air beneath the imbricated stream in a direction opposite to the conveying direction.

11 Claims, 4 Drawing Sheets

APPARATUS FOR THE UNDERLAP IMBRICATED FEEDING OF SHEET-LIKE PRINTING SUBSTATES TO A PRINTING MACHINE AND METHOD

FIELD OF INVENTION

The invention relates generally to sheet feeders for printing machines, and more particularly, to a feeder for the underlap-imbricated feeding of sheet-like printing substrates to a printing machine.

BACKGROUND OF THE INVENTION

A sheet-conveying apparatus of the type using a conveying table is known, for example, from DE-PS 713 529. In the apparatus shown therein, endless suction tapes circulate in the direction of the sheet travel and are guided over stationary suction containers provided with suction slits. Sheets are thus sucked to the circulating suction tapes, and are conveyed thereby. Further, conveying apparatuses of this type are known, for example, from DE 3 331 662 C2 and DE 3 838 078 A1.

DE-AS 1 033 225 discloses a sheet-conveying apparatus having endless suction tapes which are guided around the conveying table over narrow suction ducts. This apparatus holds the sheets for conveyance to the printing machine by means of subatmospheric pressure. In addition to the suction openings of the suction chambers in the table, the table further includes blowing openings. These blowing openings are provided in order to avoid the rubbing, in particular of the trailing ends, of the printed sheets on the conveying table and the resulting damage during feeding via the table. The blowing air is intended to cause the individually sucked-on sheet to rise slightly and float on an air cushion. By means of this solution, the attempt is made to reduce the static friction between sheets and conveying table. In the case of printing substrates transported in underlap-imbricated form, however, this may have the undesirable result of causing the sheets to lift off from the transporting tapes since each sheet is guided on the suction tapes only in the front region, the rear region being overlapped over the next sheet.

DE 4 012 948 C2 discloses a conveying table which has perforated suction tapes circulating over suction openings and which exhibits, in parallel along the borders of each suction tape, openings which are connected to the surroundings separately from the suction space.

The potential disadvantage with these solutions in the context of underlap-imbricated feeding is that they are directed largely to correcting for the adhesion between sheets and the conveying table. However, adherence between imbricated printing substrates may cause significant problems in cases where potential printing substrates which adhere strongly to one another are used. Such adherence may arise a result of adhesion and/or static charge and are particularly pronounced when films are used as the printing substrates. Adherence between underlap-imbricated substrates leads to the problem that—when the preceding printing substrate runs into the printing unit—it entrains the following printing substrate in the imbricated stream. This entrainment may cause a variety of problems. For example, the following printing substrate may "shoot", as a multiple sheet and/or mis-fed sheet, beyond the front lays and/or top lays. Alternatively, the following substrate may form waves and buckles when it is taken over by the pre-gripper. Further still, the following substrate may run into the printing zone. Any of these may result in deformation and jamming.

SUMMARY OF THE INVENTION

According to these and other objects of the invention, an apparatus and method of underlap-imbricated feeding of sheet-like substrates is provided wherein sheets are conveyed over a conveying table to front lays, and wherein compressed air is blown at a defined angle, counter to the conveying direction, onto the conveying table or in the region of the aligning unit. The compressed air is directed between the imbricated stream, preferably between the front sheetlike printing substrates of the imbricated stream, close to the printing units. This has the effect of eliminating or markedly reducing the adhesion forces in the imbricated stream in a defined region, thus allowing the underlap-imbricated printing substrates to be fed reliably to the printing unit. The apparatus according to the invention is arranged in the region of the aligning unit or in that region of the conveying table which is directed towards the printing unit. This is because the adhesion forces between the adjacent printing substrates need to be eliminated before the leading printing substrate comes to bear on the front-top lays.

The solution according to the invention achieves smooth sheet transportation, even in the case of relatively high machine speeds. The disadvantages, such as multiple sheets and/or mis-fed sheets, and the formation of waves or deformations of the printing substrate, are thus eliminated.

BRIEF DESCRIPTION OF THE DRAWINGS

The invention is to be explained in more detail by way of exemplary embodiments as shown in the following drawings, wherein.

DETAILED DESCRIPTION OF THE PREFERRED EMBODIMENTS

While the invention will be described and disclosed in connection with certain preferred embodiments, it is not intended to limit the invention to those specific embodiments. Rather, it is intended to cover all such alternative embodiments and modifications as fall within the spirit and scope of the invention as defined by the appended claims. Moreover, the references cited herein are hereby expressly incorporated herein, in their entirety, by reference.

Figure 1:
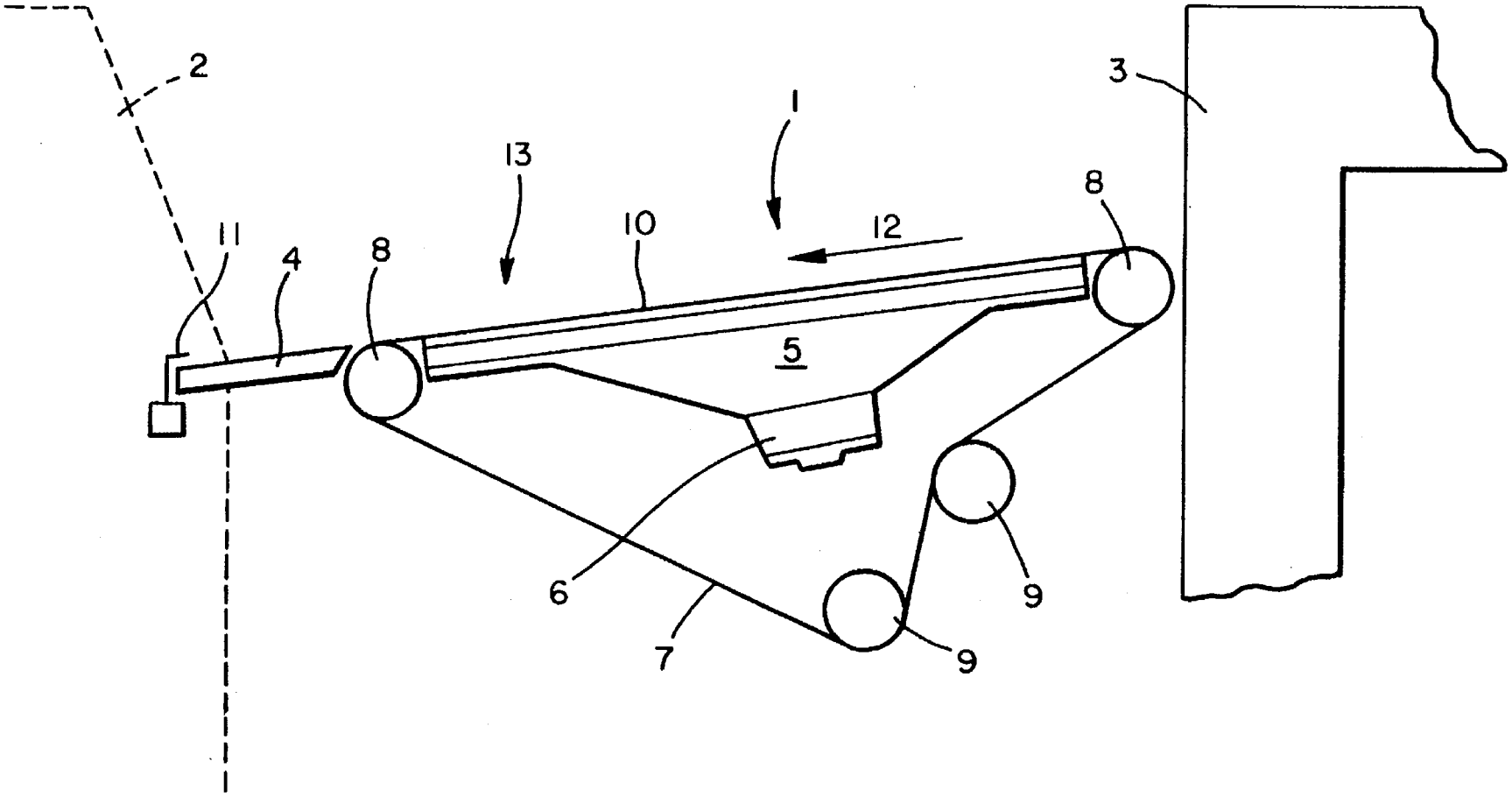
FIG. 1 shows the schematic arrangement of a conveying table in a sheet-processing printing machine according to the invention.

Referring to FIG. 1 of the drawings, a conveying table 1 in the form of a suction-tape table is arranged between a printing unit 2 and a feeder 3. It has a suction space 5 on the underside thereof with an axial-flow suction fan 6. The suction space 5 and axial-flow fan 6 form a joint storage space for building up the necessary subatmospheric pressure for gripping the sheets to be conveyed.

For transferring sheets across the table, perforated suction tapes 7 are guided in a conveying table surface 10. The suction tapes 7 are guided over tensioning rollers 9 on the underside of the conveying table 1 and over driving or guiding shafts 8 on the end sides. The conveying table 1 has a continuous series of interruptions in the region of the suction tape 7, with the result that a suction-air flow is applied over the entire length of the conveying table. An aligning unit 4 with front lays 11 is arranged between the conveying table 1 and the printing unit 2.

Figure 2:
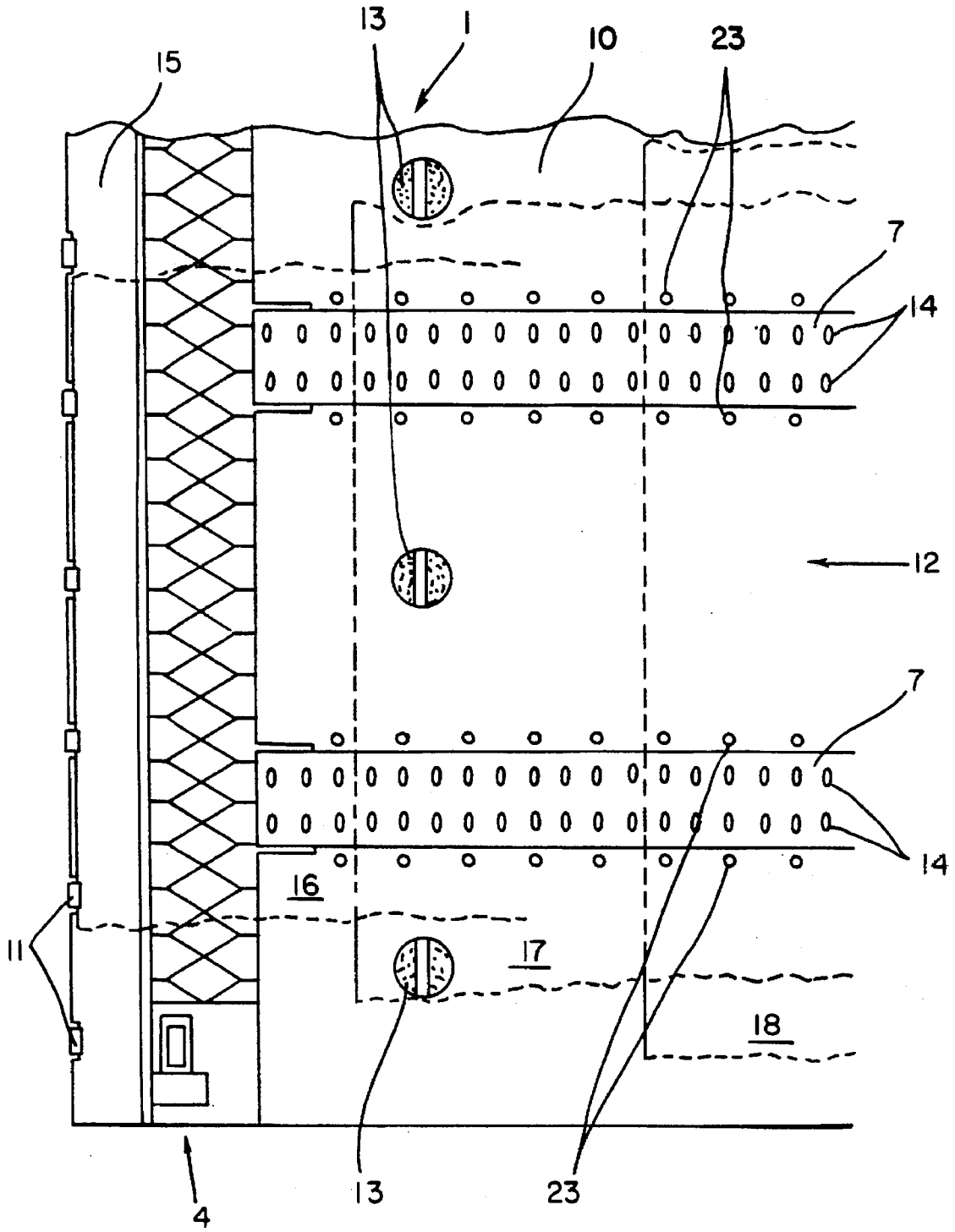
FIG. 2 Shows a schematic plan view of conveying table of FIG. 1.

The alignment unit 4 in this case comprises a lay plate 15 and a plurality of front lays 11, as shown in FIG. 2. The suction tapes 7 are set into the conveying-table surface 10 in guide grooves and have uniformly distributed suction openings 14. Parallel to the borders of each suction tape 7, ventilation openings 23 are arranged in the conveying table 1 on both sides of said suction tapes, the ventilation openings being connected to the surroundings separately from the suction space 5.

Figure 3:
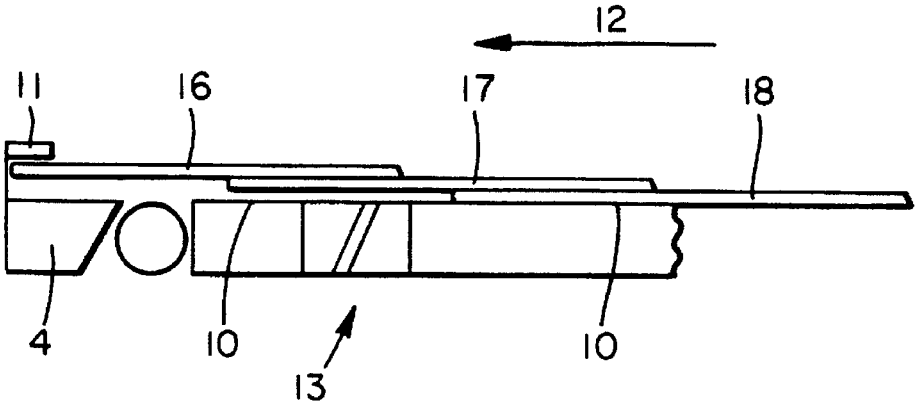
FIG. 3 shows a schematic representation of the imbricated stream in the region of the aligning unit and of the conveying table.

In the conveying table 1 in the vicinity of the aligning unit 4, a plurality of blowing devices 13 are arranged in a row transverse to the conveying direction 12 of the imbricated stream of sheets, which in this instance is represented by imbricated sheets 16 to 18. The first sheet 16 of the imbricated stream, as depicted in FIG. 3, bears on the front lays 11 and the trailing edge lies above the front edge of the sheet 17 which follows in the conveying direction 12. Likewise, the trailing edge of the sheet 17 covers over the leading edge of the following sheet 18.

Figure 4:
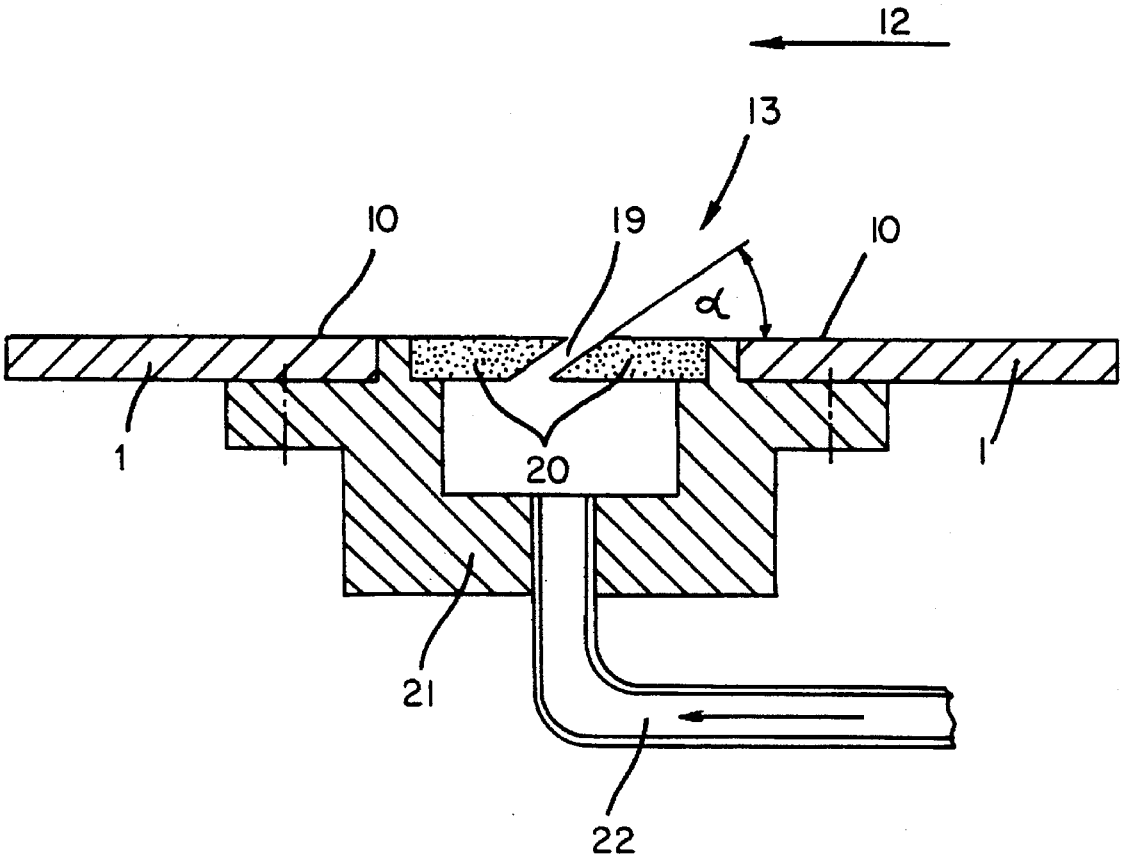
FIG. 4 shows a side view (section) of a blowing device according to the invention.

In accordance with the invention, the blowing devices are operable for directing pressurized air streams beneath the imbricated stream of sheets in a direction opposite to the conveying direction. The illustrated blowing devices 13 are integrated in the conveying table surface 10. Preferably, each blowing device is set into the conveying table surface 10, as depicted in FIG. 4. Alternatively, it may be mounted at a somewhat lower level, but it will be appreciated that it should not project out of the plane of the conveying table surface. Each blowing device 13 includes a body 21 having a microporous structure 20, such as a disk-like member made of sintered metal. The body 21 is mounted in an upper end of the table with the microporous structure 20 in this case defining an air permeable surface formed with an air opening 19. The body 21 preferably is releasably and removably mounted in the conveying table 1.

In carrying out the invention, the blowing device openings 19 in the microporous structures 20 are inclined to the vertical, counter to the conveying direction, at an acute angle $\alpha$ with respect to the conveying-table surface 10. The preferred angle range of the inclined opening 19 is between 20° and 40°. In the present example, and as can be seen in FIG. 2, the opening 19 is designed as a slit running transversely with respect to the conveying direction 12. Likewise, a plurality of slits or bores may be arranged one beside the other in the structure 20 and be inclined at an angle $\alpha$. The body 21 is connected to a compressed-air feeding means 22.

Figure 5:
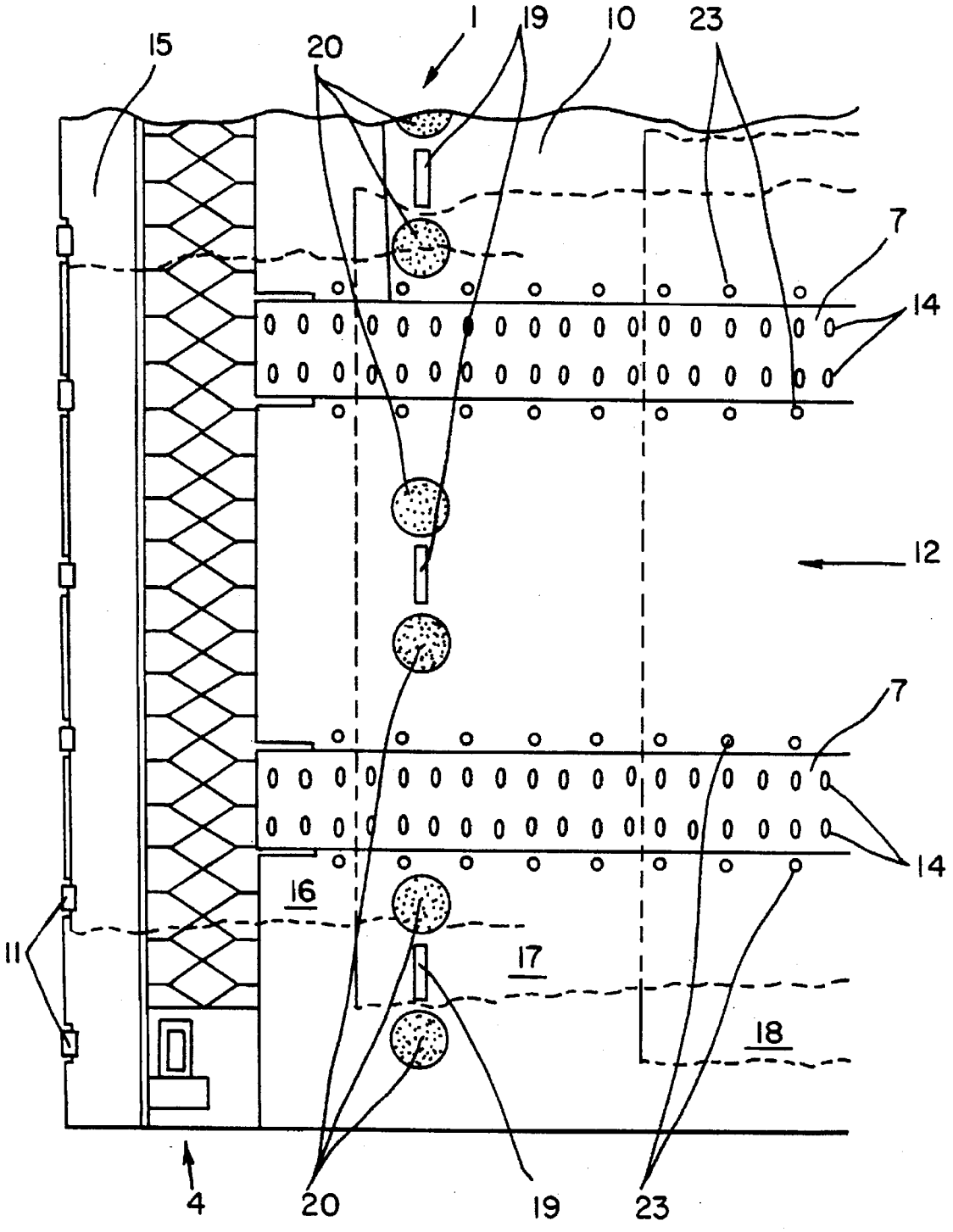
FIG. 5 shows a further schematic plan view of a conveying table.

FIG. 5 is analogous to FIG. 2, but the blowing device 13 is arranged such that the microporous structure 20 and the opening 19, here in the form of a slit, are separated. A number of structures 20 and associated openings 19 are set into the conveying-table surface 10 in one row transversely with respect to the conveying direction 12 of the substrates 16 to 18. All the blowing devices 13 of this configuration are coupled to a joint compressed-air feeding means 22 (for all structures 20 with associated openings 19).

In a further example, which is not shown here, a number of rows of the blowing devices 13, connected to the compressed-air feeding means 22, with microporous structure 20 and openings 19, may be arranged transversely with respect to the conveying direction 12. The blowing devices 13, running transversely with respect to the conveying direction, are preferably arranged in that region of the conveying table 1 which is directed towards the printing unit 2 or in the imbricated stream upstream of the front lays 11. It has been found that the advantageous elimination of reduction in the adhesion of the underlay-imbricated printing substrates is optimum if the blowing devices are disposed in the region between the first and third sheets 16 to 18.

Both the conveying table shown in FIG. 2 and that shown in FIG. 5 have similar operation. From the feeder 3, the printing substrates to be processed are fed, in underlap-imbricated form, as an imbricated stream to the printing unit 2 in the conveying direction 12. The respectively bottom, front part of the printing substrate, sucked on firmly by the suction tape 7 in a manner known per se, is transported over the conveying-surface table 10. In the aligning unit 4, each printing substrate is aligned at its front and side edges once it has been released from the suction tapes 7 and the conveying-table surface 10. As the underlay-imbricated printing substrate is fed, in the form of sheets 16 to 18, to the front lays 11 in the conveying direction 12, compressed air flows continuously beneath the imbricated stream from each blowing device 13, counter to the conveying direction 12. The compressed air is regulated such that each sheet 16, 17 and 18 is fixed securely on the suction tapes 7, but at the same time the adhesion forces and/or static charges (in the case of film) between the conveying-table surface 10 and imbricated stream and, in particular, between the underlay-imbricated sheets 16, 17 and 8, are eliminated or vastly reduced by the formation of an air cushion. The static friction between underlay-imbricated sheets 16, 17 and 18 in the imbricated stream and the motional friction when aligning each individual sheet 16, 17 and 18 in the aligning unit 4 is reduced, with the result that the underlay-imbricated sheets 16, 17 and 18 are transported into the printing unit 2 in a precisely separated and correct manner.

We claim:

1. An apparatus for feeding a stream of underlap-imbricated sheet-like printing substrates to a printing machine, comprising in combination:

a) a conveying table for conveying the stream in a conveying direction toward the printing machine, b) a source of compressed air, and c) at least one blowing device coupled to the source of compressed air, the blowing device being disposed in a region of the conveying table adjacent the printing machine, and including at least one opening disposed to direct compressed air beneath the imbricated stream in a direction opposite to the conveying direction.

2. An apparatus as claimed in claim 1, wherein the blowing device includes a body having a microporous portion including an air permeable surface adjacent the conveying table surface, and an adjacent larger opening disposed to direct the compressed air in a direction counter to the conveying direction.

3. An apparatus according to claim 2, wherein the larger opening is integrated in the microporous portion of the body.

4. An apparatus as claimed in claim 2, wherein the larger opening is separate from but adjacent to the microporous portion of the body, the opening and the microporous portion being coupled jointly to the source of compressed air.

5. An apparatus as claimed in claim 1, wherein the conveying table includes suction openings and perforated suction tapes running around the table to grip and convey the imbricated stream.

6. An apparatus as claimed in claim 1, wherein a plurality of the blowing devices are arranged in the conveying table in at least one row disposed transversely to the conveying direction.

7. An apparatus as claimed in claim 6, wherein the imbricated stream includes at least leading, second and third overlapped sheets, and wherein front lays are disposed between the conveying table and the printing machine, the row of blowing devices being disposed in the conveying table at a position between the leading and third sheets with the leading sheet engaging the front lays.

8. An apparatus as claimed in claim 1, wherein the larger opening is disposed at an acute angle with respect to the surface of the conveying table, the direction of the acute angle being opposite the conveying direction.

9. An apparatus as claimed in claim 8, wherein the larger opening is a slit disposed at an acute angle with respect to the surface of the conveying table.

10. An apparatus for feeding a stream of underlap-imbricated sheet-like printing substrates to a printing machine, comprising in combination:

a) a conveying table for conveying the stream in a conveying direction toward the printing machine, b) an aligning unit disposed between the conveying table and the printing machine, c) a source of compressed air, and d) at least one blowing device coupled to the source of compressed air, the blowing device being disposed in a region of the conveying table adjacent the aligning unit and including at least one opening disposed to direct compressed air beneath the imbricated stream in a direction opposite to the conveying direction.

11. A method for feeding a stream of underlap-imbricated sheet-like printing substrates over a conveying table to a printing machine, comprising the steps of:

a) conveying the stream over said conveying table in a conveying direction toward the printing machine, and b) directing a flow of compressed air beneath the imbricated stream at a location on the conveying table adjacent the printing machine and at an acute angle to the table in a direction opposite to the direction the stream is being conveyed to reduce adhesion between individual printing substrates and between the substrates and the conveying table.

* * * * *